US009078317B1

(12) United States Patent
Szolusha

(10) Patent No.: US 9,078,317 B1
(45) Date of Patent: Jul. 7, 2015

(54) FLOATING OUTPUT VOLTAGE BOOST REGULATOR DRIVING LEDS USING A BUCK CONTROLLER

(71) Applicant: Linear Technology Corporation, Milpitas, CA (US)

(72) Inventor: Keith D. Szolusha, Saratoga, CA (US)

(73) Assignee: Linear Technology Corporation, Milpitas, CA (US)

( * ) Notice: Subject to any disclaimer, the term of this patent is extended or adjusted under 35 U.S.C. 154(b) by 0 days.

(21) Appl. No.: 14/332,830

(22) Filed: Jul. 16, 2014

Related U.S. Application Data

(60) Provisional application No. 61/975,369, filed on Apr. 4, 2014.

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
None
See application file for complete search history.

(56) References Cited

U.S. PATENT DOCUMENTS

| | | | | |
|---|---|---|---|---|
| 7,233,115 | B2 * | 6/2007 | Lys | 315/291 |
| 7,598,685 | B1 * | 10/2009 | Shteynberg et al. | 315/308 |
| 8,278,832 | B2 * | 10/2012 | Hung et al. | 315/219 |
| 2005/0133800 | A1 * | 6/2005 | Park et al. | 257/80 |
| 2010/0213857 | A1 * | 8/2010 | Fan | 315/186 |
| 2011/0068700 | A1 * | 3/2011 | Fan | 315/185 R |
| 2011/0080102 | A1 * | 4/2011 | Ge et al. | 315/200 R |
| 2013/0002165 | A1 * | 1/2013 | Rouvala et al. | 315/294 |
| 2013/0099686 | A1 * | 4/2013 | Ge et al. | 315/186 |

* cited by examiner

*Primary Examiner* — Crystal L Hammond
(74) *Attorney, Agent, or Firm* — Patent Law Group LLP; Brian D. Ogonowsky

(57) ABSTRACT

An LED driver uses a positive-to-floating boost converter topology to generate a negative voltage −Vee relative to ground. The converter receives an input voltage. Vin from a power supply. One end of an output inductor is coupled to ground, and the other end of the inductor is coupled between a highside switch and a low side switch. The bottom terminal of the lowside switch generates −Vee. The anode end of an LED string is coupled to Vin and the cathode end is coupled to −Vee. The converter detects the LED current and regulates the switching duty cycle so that the LED current is equal to a target current. This is more efficient than coupling the anode end of an LED string to ground and the cathode end to −Vee. A conventional buck controller IC may be used.

16 Claims, 4 Drawing Sheets

FLOATING OUTPUT VOLTAGE BOOST REGULATOR DRIVING LEDS USING A BUCK CONTROLLER

CROSS REFERENCE TO RELATED APPLICATIONS

This application claims priority from U.S. provisional application Ser. No. 61/975,369, by Keith D. Szolusha, filed Apr. 4, 2014, incorporated by reference.

FIELD OF INVENTION

The present invention relates to voltage or current regulators and, in particular, to a positive-to-floating boost regulator configuration, using a buck controller IC, to efficiently drive a string of light emitting diodes (LEDs).

BACKGROUND

It is common to drive a series string of LEDs using a positive voltage boost converter, where the LEDs are connected between the boosted output voltage terminal and ground. FIG. 1 illustrates such a conventional boost LED driver. The input voltage Vin, generated by a power supply PS, is coupled to one end of an inductor L. A boost controller 10 receives feedback signals and controls the duty cycle of transistor switches 12 and 14 to supply a regulated current through the string of LEDs 16. A MOSFET 18, connected in series with the LEDs 16, is controlled by a pulse-width-modulation (PWM) dimmer circuit to control the perceived brightness of the LEDs 16.

When the switch 14 is on, an upward ramping current flows through the inductor L to charge the inductor L to a regulated peak current. After the peak current is reached, the switch 14 is turned off and the switch 12 is turned on. A downward ramping inductor current flows through the switch 12. The switch 14 then turns back on at the beginning of the next switching cycle, controlled by an oscillator. The switch current is smoothed by the output capacitor Cout.

The switch current Isw and LED current ILED through the low value sense resistors 20 and 22 are sensed, by measuring the respective voltage drops across the resistors, to provide the Isw and ILED feedback signals to the boost controller 10. The controller 10 uses these feedback signals to control the switch 14 duty cycle to supply a target regulated current through the LEDs 16 when the MOSFET 18 is on.

The average current through the switch 12 is also the average current through the LEDs 16 and the sense resistor 22. The boost converter of FIG. 1 regulates the LED current to a target value, and the boosted voltage Vout across the LED string and the capacitor Cout is higher than the input voltage Vin.

There are other possible boost converter configurations.

In some instances, it is not desirable to use such a boost converter, such as if the required boosted output voltage is higher (relative to ground) than a level that is safe for an application. Additionally, other available switching controllers intended for non-boost topologies may have features that are desirable, but these features are not available in an available boost controller. For example, there may be features of a buck controller IC that are particularly appealing to a user wanting to drive a string of LEDs in a certain application, but the application requires a boosted voltage across the LEDs.

One possible way to drive a string of LEDs with a boosted voltage, while using a conventional buck controller IC, is shown in FIG. 2. FIG. 2 illustrates a positive-to-negative buck-boost converter using a conventional buck controller IC, renamed as a positive-to-negative buck-boost controller 24. In this topology, the anode end of the string of LEDs 16 is connected to ground, and the cathode end is connected to a negative voltage output terminal generating −Vee. Thus, the converter is a positive-to-negative converter, relative to ground.

When the highside switch 26 is on, an upward ramping current flows through the switch 26 and inductor L until a regulated peak current is reached. This highside switch control is common in buck converters.

After the peak current is reached, the switch 26 is turned off and the lowside switch 28 is turned on. The left end of the inductor L then goes negative and the inductor current IL ramps down. The switch 26 then turns back on at the beginning of the next switching cycle, determined by an oscillator. The inductor current IL and LED current ILED is sensed by the low value sense resistors 20 and 22 and provide feedback signals into the controller 24 for regulating the current through the LEDs 16 to match a target current set by the user. The output capacitor Cout smooths the ripple in the inductor current IL provided to the output.

In this topology, the average current through the inductor is the sum of the average current through the LEDs 16 plus the average input current that flows through the power supply PS via the ground terminal connected to the string of LEDs. As a result, the average current through the inductor L and the switches 26/28 is higher than the average current in the boost converter of FIG. 1.

This higher current results in significant power losses through the switches 26/28 and inductor L. Therefore, although the basic positive-to-negative buck-boost converter topology of FIG. 2 (using a conventional buck controller) offers an alternative to the boost converter of FIG. 1, it is less efficient than the boost converter.

Two advantages of the converter of FIG. 2, however, are low output ripple, which is common to a buck converter, and the use of a buck controller IC which may have a useful feature that is not found in an available boost controller IC, such as short-circuit protection. The boost converter of FIG. 1 typically has low input ripple (ripple on the power supply bus), since the power supply is placed in series with the inductor. The positive-to-negative buck-boost converter of FIG. 2 transfers a low input ripple to the output and transfers a higher ripple to the input (via the ground terminal), resulting in an undesirable high input ripple. This is common for a buck converter. This not only makes it harder to achieve a constant output current, but it causes ripple on the power supply bus which may affect other circuitry in the system.

What is needed is an LED driver that can use a conventional buck controller but does not suffer from the higher inefficiency and the high input ripple of the topology of FIG. 2.

SUMMARY

For driving a string of LEDs, it is not necessary that the LEDs be connected to ground, since it is only the current through the LEDs (and resulting voltage across the LEDs) that controls the brightness of the LEDs.

In one embodiment of the present invention, a buck type regulator controller is configured to create a boosted output voltage between a positive and negative rail. Neither end of the LED string load is attached to ground. The anode end of the LED load is connected to the positive Vin, rather than ground (in contrast to FIG. 2), and the cathode end of the LED load is connected to the negative voltage −Vee generated by the converter. Neither Vin nor −Vee is regulated by the converter, since only the current through the LEDs is regulated. Therefore, the converter is a floating output boost regulator.

The average inductor current is the DC input current, and the switch current level average (during the on-times) is the DC input current (and not the DC input current plus the LED current, as it is for the converter of FIG. 2). Therefore, the average current though the inductor and switches is less than that of the converter of FIG. 2 but the same as that of the converter of FIG. 1. Hence, there are lower power losses through the inductor and switches compared to the power losses incurred in the converter of FIG. 2, and the advantages of using an available buck controller IC are utilized.

The current through the LED string is regulated by detecting the voltage drop across a sense resistor in series with the string of LEDs. There is a PWM MOSFET in series with the string that is used for PWM dimming.

One end of the inductor is connected to ground via an inductor current sense resistor. The inductor is placed in series with the power supply input voltage and ground when the highside switch is turned on. When the highside switch is on, the voltage across the inductor is Vin and the inductor current ramps up to a peak value set by the control loop of the converter. When the peak value is reached, the highside switch turns off and the lowside switch turns on. This places a resulting negative voltage −Vee (referenced to ground) across the inductor, ramping the current down. When the next switching cycle starts, the highside switch turns back on. The instantaneous inductor current and LED current are sensed by the sense resistors and fed back to the controller IC to regulate the LED current to match a target current. Basically, the inductor peak current is regulated to achieve the target LED current.

The average inductor current is the input current to the converter from the power supply. The input current to the converter has low ripple since it is in series with the inductor, therefore there is low ripple on any power supply bus. Common to typical boost converters, this floating output regulator has low input ripple and low conducted EMI due to the series input inductor.

The ripple currents, duty cycle, and efficiency are the same as a typical boost converter even though the topology is slightly different, yet additional benefits are achieved by the inventive topology.

A novel configuration for the highside MOSFET switch driver is employed since the source of the MOSFET switch is at −Vee when the synchronous rectifier is on and then at a variable voltage when the synchronous rectifier is off. In one embodiment, the rail voltages for the highside driver are −Vee and a boosted positive voltage.

Not only does the present invention enable the system designer to use a wide variety of existing buck controller ICs (with all their features) to implement the floating output regulator, but the magnitude of −Vee is lower than the magnitude of the boosted voltage in the conventional LED driver, since the required voltage across the LED string is Vin+Vee in the invention. Therefore, the magnitudes of the voltages, relative to ground, generated with the present invention are lower than those generated in the circuits of FIGS. 1 and 2. This improves safety margins and enables a longer string of LEDs to be driven while meeting the applicable "low voltage" safety codes.

The circuit can use either a single switch controller topology (asynchronous) or a two-switch topology (synchronous). The controller can be a conventional buck controller IC.

The same topology may be used to drive any load that requires a boosted voltage drop across its terminals but does not require being connected to ground, such as a motor, laser diode driver, OLED driver, battery charger, or floating voltage regulator. For driving OLEDs, a regulated output voltage is sometimes generated rather than a regulated current. The converter of the present invention is easily configured to regulate the Vin+Vee voltage across the OLEDs rather than the OLED current.

DETAILED DESCRIPTION

Figure 3:
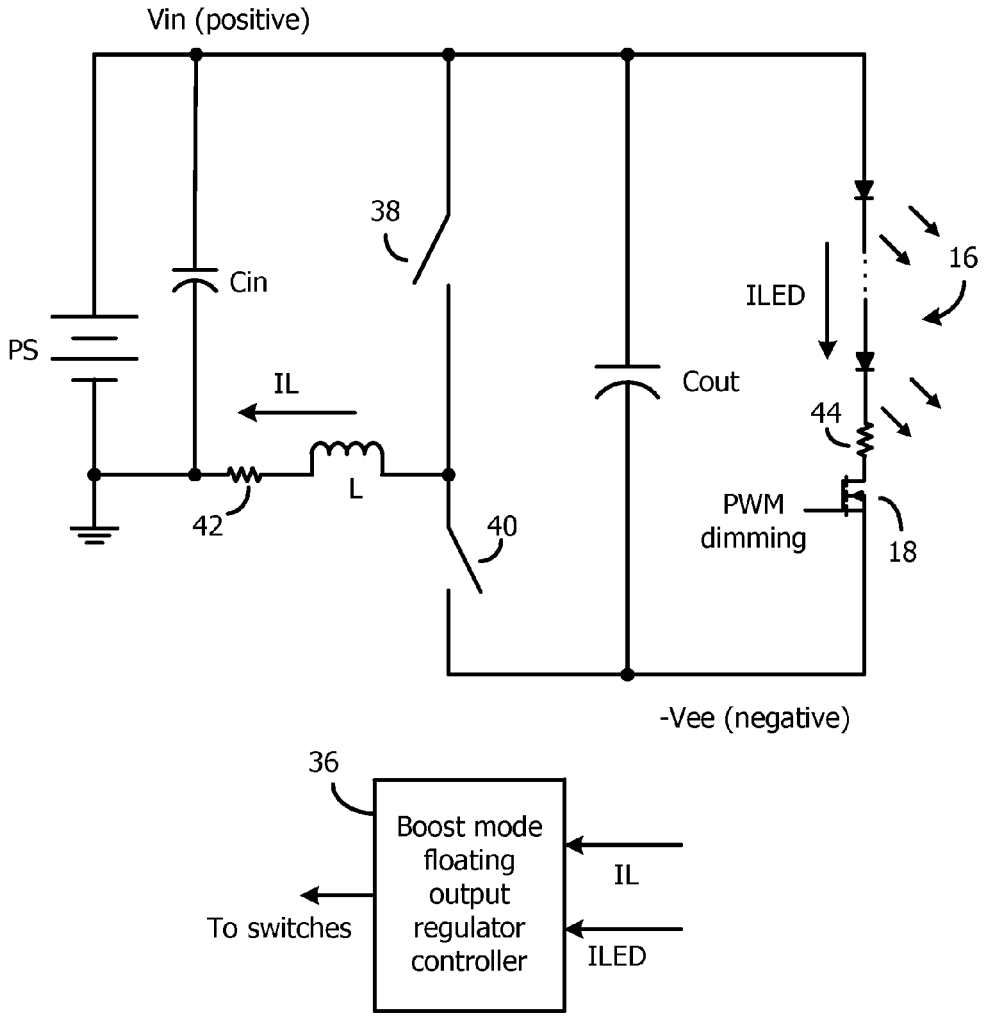
FIG. 3 illustrates an embodiment of the invention using a buck controller in a converter that has a floating negative voltage output, wherein neither output terminal is regulated, where the cathode end of the LED string is connected to Vin so that the current through the inductor and switches is reduced to increase the efficiency of the converter and to reduce the EMI to that of a typical boost converter.

FIG. 3 illustrates an embodiment of the invention. The floating regulator controller 36 may be a conventional buck controller IC connected in the novel configuration. The controller 36 may have various features unrelated to the present invention but are desired for the system designer.

A power supply PS provides the input voltage Vin relative to ground. The string of LEDs 16 is connected across Vin and a boosted negative voltage −Vee (relative to ground) generated by the converter. −Vee can be any voltage below ground, and it is the voltage needed to conduct a target regulated current through the LEDs 16. Since neither Vin nor −Vee is regulated by the converter, the output is considered to be floating.

In one example, the LEDs 16 may be ten series-connected LEDs requiring about 35 volts to be turned on. Therefore, Vin+Vee must be at least 35 volts. The LED load may be any other load that does not need to be connected to ground.

Figure 1:
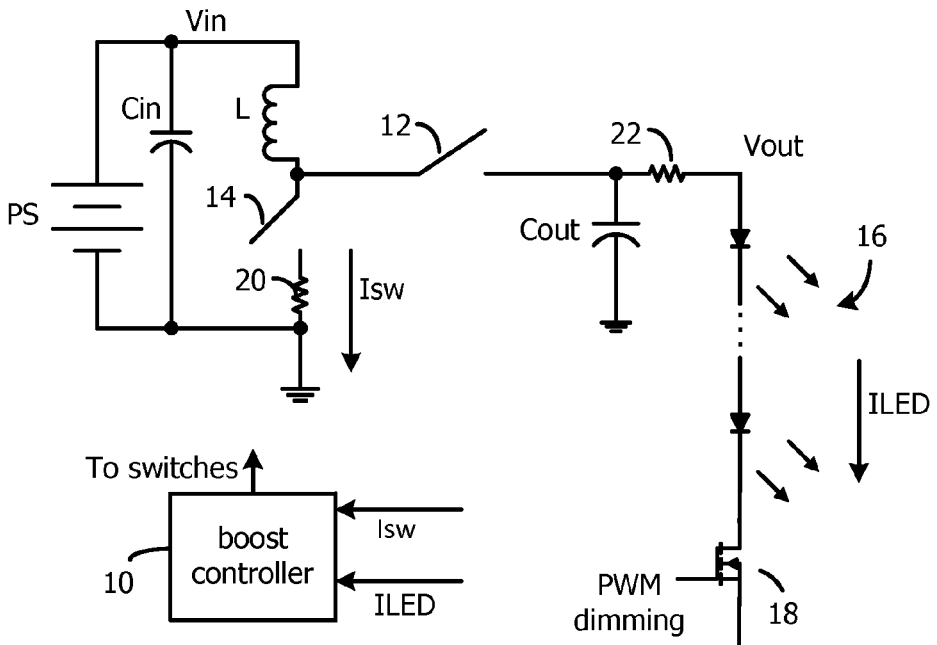
Fig. 1 (prior art)
FIG. 1 illustrates a conventional boost converter driving a string of LEDs.
Figure 2:
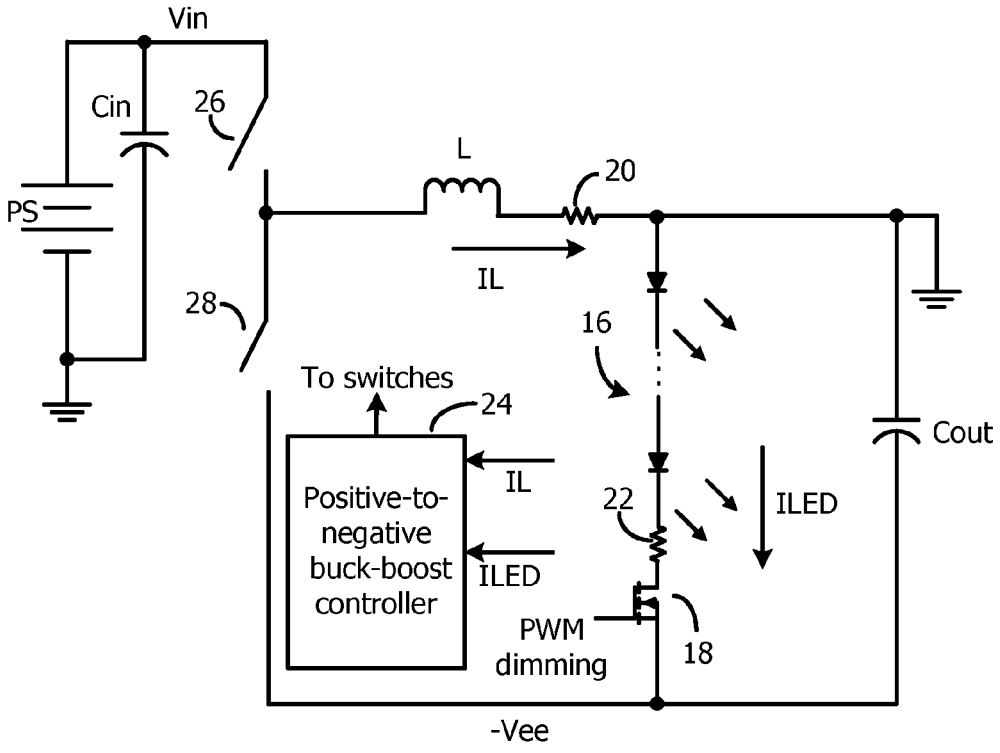
Fig. 2 (prior art)
FIG. 2 illustrates a positive-to-negative buck-boost converter using a conventional buck controller, where the anode end of the LED string is connected to ground, and where the efficiency is lower than that of the boost converter of FIG. 1.

Since all the output current through the inductor L is supplied to the LEDs 16, rather than some of the inductor output current being conducted to ground as in FIG. 2, the converter has lower inductor and switching power losses compared to the power losses of the converter of FIG. 2. The efficiency is the same as for the boost converter of FIG. 1.

With a higher Vin, the magnitude of −Vee may be decreased. This improves safety margins since, typically, the main safety concern is the magnitude of a generated voltage relative to a grounded person or component.

The controller 36 synchronously turns the switches 38 and 40 on and off at the duty cycle needed to conduct a target regulated current through the LEDs 16. The controller 36 receives feedback signals from the voltage drops across low value sense resistors 42 and 44.

The instantaneous ramping inductor current is sensed by the resistor 42, and the constant LED current is sensed by the resistor 44. The resistors 42 and 44 may be connected at any location in the circuit that conducts the same current. For example, the resistor 42 may be located above or below the switch 38 (and may even be an inherent resistance in the switch 38), and the resistor 44 may be on the anode side of the LED string.

The current regulation occurs when the PWM MOSFET 18 is on. The controller 36 will typically generate the PWM dimming signal at a frequency above 60 Hz to avoid perceived flicker, and the switching frequency of the switch 38 is typically 100 kHz-5 MHz. When the controller 36 turns off the MOSFET 18, the switching of the switches 38/40 is stopped, and the output capacitor Cout maintains a relatively constant voltage across its terminals. When the controller 36 turns the MOSFET 18 on, the switching resumes.

The converter regulates a peak current through the inductor and switch 38 needed to keep the current though the LEDs 16 at the target current. The user typically sets the target current with an external component, such as a resistor, since the target current depends on the LEDs 16 used and the desired brightness.

An input capacitor Cin supplies some of the current through the switch 38 so there is less ripple on any power supply bus. This reduces EMI.

Figure 4:
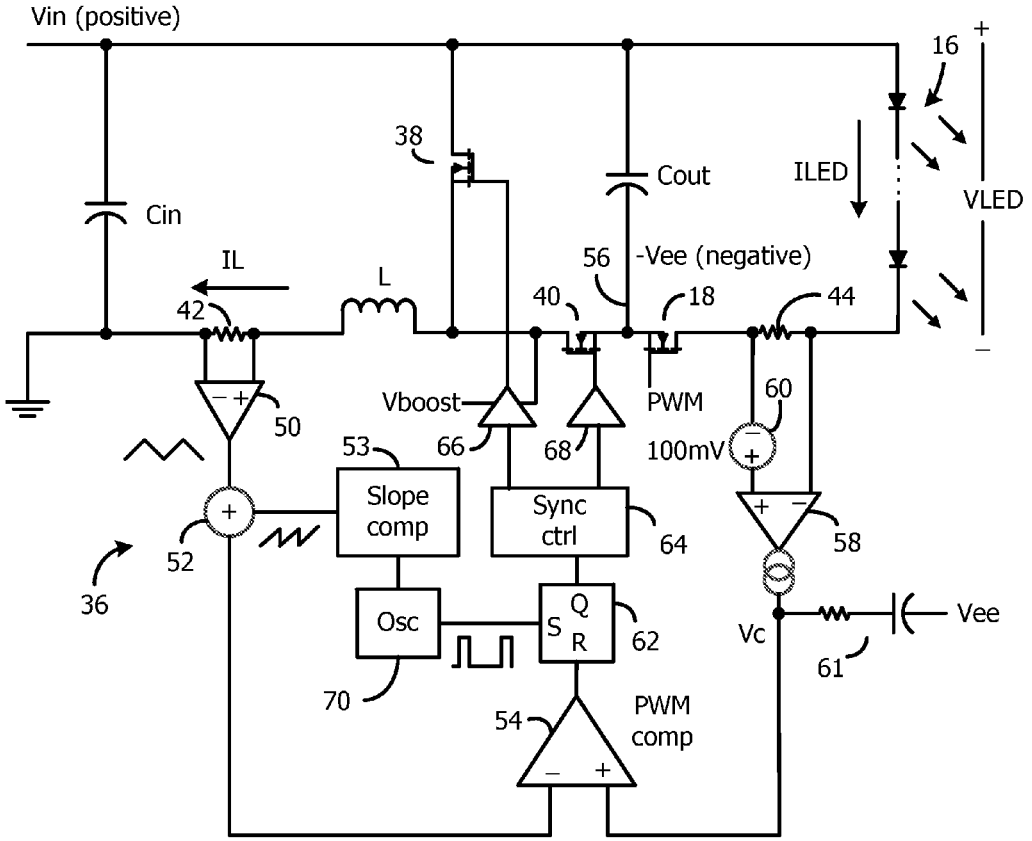
FIG. 4 illustrates more detail of an embodiment of FIG. 3.

FIG. 4 shows more detail of one possible embodiment of the controller 36, and the description of the operation of FIG. 4 will be described with reference to the voltage and current waveforms of FIG. 5. It is assumed that the PWM dimming MOSFET 18 is closed. FIG. 4 shows the switches 38 and 40 as N-channel MOSFETs, but other types of switches can be used.

Let's assume that the switch 38 is on and the switch 40 is off. FIG. 5 shows the voltage across the closed switch 38 being 0 volts and the voltage across the open switch 40 being Vin+Vee. The voltage across the output capacitor Cout is Vin+Vee.

Figure 5:
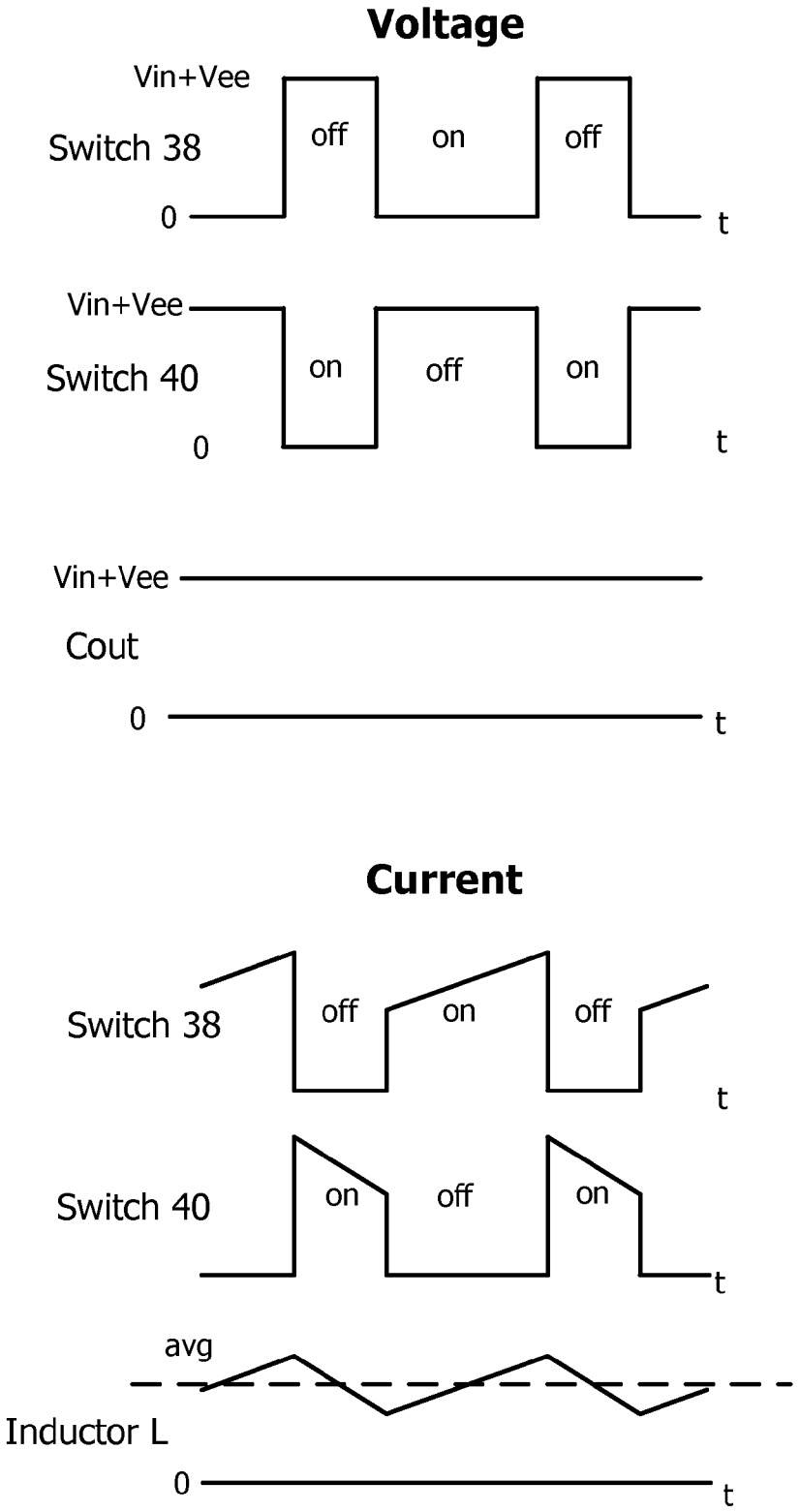
FIG. 5 illustrates voltage and current waveforms generated in the converters of FIGS. 3 and 4.

Since the inductor L is connected across Vin and ground, an upward ramping current flows through the inductor L, as shown in FIG. 5, to charge the inductor L. The voltage drop across the sense resistor 42 is sensed by a difference amplifier 50, which suitable amplifies the difference. The output of the amplifier 50 is applied to an input of a summer 52. A synchronized upward ramping sawtooth waveform from a slope compensator 53 is applied to the other input of the summer 52 for slope compensation at the larger duty cycles. Slope compensation is conventional.

The output of the summer 52 is an upward ramping signal and applied to an input of a PWM comparator 54.

During this time, a regulated smoothed LED current ILED flows through the LEDs 16 between the Vin terminal of the power supply and the Vee terminal 56 (supplying a negative voltage relative to ground). The voltage drop across the sense resistor 44 corresponds to the LED 16 current. The highside terminal of the resistor 44 is coupled to one input terminal of a transconductance error amplifier 58, and the lowside terminal of the resistor 44 is coupled to an offset voltage 60, whose value sets the target regulated current. The offset voltage level is set so that the inputs into the error amplifier 58 are equal at the target current. The user may set the offset voltage level with an external component, such as a resistor, or it may be fixed inside the IC.

The output of the error amplifier 58 is connected to an RC circuit 61 to generate a control voltage Vc that sets the peak current though the inductor L and switch 38. The control voltage Vc is coupled to the other input of the PWM comparator 54.

When the ramping signal from the summer 52 crosses the Vc level, the output of the PWM comparator resets an RS flip flop 62. The resulting low output of the flip flop 62 controls a synchronous controller 64 to supply signals to drivers 66 and 68 to turn off the switch 38 and turn on the switch 40, ensuring no significant cross-conduction.

The drivers 66 and 68 may be push-pull drivers, where a pull-up transistor couples the output of the driver to a highside rail voltage, and pull-down transistor couples the output to a lowside rail voltage. The driver 66 must be able to keep the switch 38 off when −Vee is connected to its source terminal (when the switch 40 is on). Therefore, the driver 66 must supply −Vee to the gate of the switch 38 MOSFET to keep the switch 38 off when the switch 40 is on, yet supply a positive threshold voltage to the gate to turn the switch 38 on after the switch 40 has turned off. Accordingly, −Vee is applied to the driver 66 as a lowside rail voltage, so a pull-down transistor in the driver 66, coupled between −Vee and the switch 38 gate, can couple −Vee to the gate of the switch 38 to turn it off and keep it off when switch 40 is on. A positive rail voltage is also applied to the driver 66, which is coupled to the gate of the switch 38 by a pull-up transistor in the driver 66 to turn it on when the switch 40 is off. This positive rail voltage must be higher than the right side of the inductor L in order to provide a gate voltage to turn on the switch. In one embodiment, a capacitor charge pump is used to create a boosted voltage (Vboost) for the driver 66 positive rail voltage, where the boosted voltage is relative to the voltage on the right side of the inductor L.

In contrast, since the source of the switch 40 is always at −Vee, the high and low rail voltages applied to the driver 68 just need to be at least a threshold voltage more positive than −Vee (for turning switch 40 on) and Vee. Care must be given to not exceed the gate oxide breakdown voltage when −Vee is large, so the turn-on gate voltage should be generated relative to −Vee, such as 5 volts more positive than −Vee. In one embodiment, a linear regulator (an LDO regulator) receives Vin and generates a regulated voltage relative to −Vee, as the turn-on voltage for the switch 40.

If the switch 38 was a PMOS transistor, the gate voltage for turning the switch 38 on and off would then just be referenced to Vin.

When switch 40 is on and switch 38 is off, the current through the inductor L ramps down. At the start of the next switching cycle, controlled by an oscillator 70, the flip flop 62 is set to turn on the switch 38 and turn off the switch 40, and the feedback process repeats. A typical switching frequency is between 100 kHz and 5 MHz.

An input capacitor Cin filters the input voltage Vin so that the switching current surges do not significantly affect the voltage on any power supply bus.

The sense resistors 44 and 42 may be located at other points along their same current path.

Compared to the prior art circuit of FIG. 2, there is a reduction in switching and inductor power losses so the circuit is very efficient. Additionally, since the required −Vee is less than the required −Vee using the topology of FIG. 2, the maximum voltage requirements of the components and system may be reduced. Safety is also improved since −Vee is smaller relative to ground.

Other topologies using the basic concept of FIG. 3 are envisioned, where the load is connected between Vin and the negative voltage generated by the converter.

All components of the converter may be formed in a single integrated circuit.

The synchronous rectifier switch 40 may be replaced with a diode to form an asynchronous converter rather than a synchronous converter. In such a case, the anode of the diode is connected to the −Vee terminal 56 and the cathode is connected to the end of the inductor. The synchronous rectifier and the diode are both referred to as rectifiers in this context since they are used to block any substantial reverse current. Many types of conventional buck controllers may be used as the controller 36 in conjunction with the disclosed novel configuration.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A current regulator system for driving a string of light emitting diodes (LEDs) with a regulated current comprising:

a first switch having a first terminal coupled to receive a positive input voltage Vin, relative to ground, from a power supply, the first switch having a second terminal coupled to a first end of an inductor;

a rectifier having a first terminal coupled to the second terminal of the first switch, the rectifier having a second terminal outputting a negative voltage −Vee relative to ground;

a second end of the inductor coupled to ground;

an LED load coupled between the positive input voltage Vin and the negative voltage −Vee such that approximately a voltage equal to Vin+Vee is applied across the LED load; and a controller connected to detect a current through the LED load and control a switching duty cycle of the first switch, at a switching frequency, to regulate the LED current to substantially match a target current.

2. The system of claim 1 wherein the first switch is an N-channel MOSFET, the system further comprising a driver coupled to the first switch, where the driver has a low rail voltage terminal coupled to −Vee and a high rail voltage terminal coupled to a voltage greater than a voltage at the first end of the inductor to enable the first switch to be on when the rectifier is not conducting and to be off when the rectifier is conducting.

3. The system of claim 1 wherein the controller is a buck controller integrated circuit.

4. The system of claim 1 wherein the rectifier is a synchronous rectifier MOSFET.

5. The system of claim 1 wherein the first switch is a MOSFET.

6. The system of claim 1 also comprising a pulse width modulation (PWM) dimming switch in series with the LEDs, where in the controller also supplies a PWM signal to the dimming switch at a frequency lower than the switching frequency of the first switch to control a perceived brightness of the LEDs.

7. The system of claim 1 wherein the controller controls a peak current through the first switch for each switching cycle to achieve the target current through the LEDs.

8. The system of claim 1 wherein the LED load is a series string of LEDs.

9. A method for driving a series string of light emitting diodes (LEDs) comprising:

providing a first switch having a first terminal coupled to receive a positive input voltage Vin, relative to ground, from a power supply, the first switch having a second terminal coupled to a first end of an inductor;

providing a rectifier having a first terminal coupled to the second terminal of the first switch, the rectifier having a second terminal outputting a negative voltage −Vee relative to ground;

wherein a second end of the inductor is coupled to ground;

providing an LED load coupled between the positive input voltage Vin and the negative voltage −Vee such that approximately a voltage equal to Vin+Vee is applied across the LED load; and detecting a current through the LED load and controlling a switching duty cycle of the first switch, at a switching frequency, to regulate the current to substantially match a target current.

10. The method of claim 9 further comprising providing a driver coupled to the first switch, where the driver has a low rail voltage terminal coupled to receive −Vee and a high rail voltage terminal coupled to a voltage greater than ground to enable the first switch to be on when the rectifier is not conducting and to be off when the rectifier is conducting.

11. The system of claim 9 wherein a controller integrated circuit detects the current through the LED load and controls the switching duty cycle of the first switch, and wherein the controller is a buck controller integrated circuit.

12. The method of claim 9 wherein the rectifier is a synchronous rectifier MOSFET.

13. The method of claim 9 wherein the first switch is a MOSFET.

14. The method of claim 9 further comprising controlling a pulse width modulation (PWM) dimming switch in series with the LEDs by supplying a PWM signal to the dimming switch at a frequency lower than the switching frequency of the first switch to control a perceived brightness of the LEDs.

15. The method of claim 9 wherein the step of controlling the switching duty cycle of the first switch, at the switching frequency, to regulate the current to substantially match a target current comprises controlling a peak current through the first switch for each switching cycle to achieve the target current through the LEDs.

16. The method of claim 9 wherein the load is a series string of LEDs.

* * * * *